US010159124B2

(12) United States Patent
Trinschek et al.

(10) Patent No.: US 10,159,124 B2
(45) Date of Patent: Dec. 18, 2018

(54) DIMMABLE LED LIGHT UNIT AND METHOD OF REPLACING A LIGHT UNIT

(71) Applicant: Goodrich Lighting Systems GmbH, Lippstadt (DE)

(72) Inventors: Robert Trinschek, Hamm (DE); Frederik Kraemer, Erwitte (DE); Carsten Geske, Oelde (DE)

(73) Assignee: GOODRICH LIGHTING SYSTEMS GMBH, Lippstadt (DE)

( * ) Notice: Subject to any disclaimer, the term of this patent is extended or adjusted under 35 U.S.C. 154(b) by 0 days.

(21) Appl. No.: 14/250,458

(22) Filed: Apr. 11, 2014

(65) Prior Publication Data

US 2014/0333223 A1 Nov. 13, 2014

(30) Foreign Application Priority Data

May 7, 2013 (EP) ..... 13166844

(51) Int. Cl.
*H05B 33/08* (2006.01)

(52) U.S. Cl.
CPC ..... *H05B 33/0815* (2013.01); *H05B 33/0845* (2013.01); *H05B 33/0854* (2013.01)

(58) Field of Classification Search
CPC ..... B60Q 3/0293; H05B 33/0803; H05B 33/0815; H05B 33/0818; H05B 33/0824; H05B 33/0833; H05B 33/0839
See application file for complete search history.

(56) References Cited

U.S. PATENT DOCUMENTS 5,938,321 A * 8/1999 Bos ..... B60Q 3/80 362/140
6,132,072 A 10/2000 Turnbull et al.
6,249,913 B1 * 6/2001 Galipeau ..... H04N 7/17318 348/E5.002
6,841,947 B2 * 1/2005 Berg-johansen ..... G09G 3/14 315/156
6,851,841 B2 * 2/2005 Sugihara ..... B60Q 3/74 362/237
7,126,290 B2 * 10/2006 Elliott ..... H05B 33/0818 315/312

(Continued)

FOREIGN PATENT DOCUMENTS

DE 10160169 A1 6/2003
WO 03096761 A1 11/2003
WO 2009039112 A1 3/2009

OTHER PUBLICATIONS

European Search Report for Application No. 13166844.4-1802 dated Mar. 21, 2014. 6 pages.

*Primary Examiner* — Alexander H Taningco
*Assistant Examiner* — Kurtis R Bahr
(74) *Attorney, Agent, or Firm* — Cantor Colburn LLP

(57) ABSTRACT

A dimmable LED light unit, in particular for a passenger transportation vehicle, such as an aircraft, a road vehicle, a ship or a rail car, is disclosed that comprises a power input adapted to receive electrical power from a power source, at least one LED, and an LED drive and control module coupled between the power input and the at least one LED, wherein the LED drive and control module is adapted to receive an LED control signal indicative of a desired light intensity of the dimmable LED light unit.

17 Claims, 3 Drawing Sheets

(56) References Cited

U.S. PATENT DOCUMENTS

| | | | | |
|---|---|---|---|---|
| 7,344,279 | B2 * | 3/2008 | Mueller | F21S 48/325 362/240 |
| 2004/0119454 | A1 * | 6/2004 | Chang | H02J 3/34 323/284 |
| 2005/0093718 | A1 * | 5/2005 | Martin | B64D 47/06 340/981 |
| 2006/0146553 | A1 * | 7/2006 | Zeng | B60Q 11/002 362/488 |
| 2006/0274540 | A1 * | 12/2006 | Klaver | H05B 33/0857 362/479 |
| 2007/0030172 | A1 * | 2/2007 | Bandy | G01C 23/005 340/945 |
| 2007/0040696 | A1 * | 2/2007 | Mubaslat | G01R 31/2635 340/657 |
| 2008/0297058 | A1 * | 12/2008 | Soos | H05B 33/0803 315/185 R |
| 2009/0267538 | A1 * | 10/2009 | Mantovani | H05B 37/02 315/297 |
| 2010/0039046 | A1 * | 2/2010 | Roebke | H05B 33/0845 315/291 |
| 2012/0001566 | A1 * | 1/2012 | Josefowicz | H05B 33/0851 315/291 |
| 2012/0069606 | A1 * | 3/2012 | Sagneri | H02M 3/158 363/21.02 |
| 2013/0241284 | A1 * | 9/2013 | Santini | H02J 4/00 307/31 |
| 2013/0300310 | A1 * | 11/2013 | Hu | H05B 33/0854 315/239 |
| 2014/0028189 | A1 * | 1/2014 | Eckel | H05B 37/02 315/85 |
| 2015/0002040 | A1 * | 1/2015 | Malyna | H05B 33/0815 315/201 |

* cited by examiner

DIMMABLE LED LIGHT UNIT AND METHOD OF REPLACING A LIGHT UNIT

CROSS REFERENCE TO RELATED APPLICATIONS

This application claims priority to European Patent Application No. 13 166 844.4 filed May 7, 2013, the entire contents of which is incorporated herein by reference.

TECHNICAL FIELD

The invention relates to interior lighting systems for passenger transport vehicles, such as aircraft, road vehicles, ships or rail cars. In particular, it relates to a dimmable LED light unit for such passenger transport vehicles.

BACKGROUND

In some passenger transport vehicles, such as air planes, dimmable light units have started to become common place in the interior of the cabin. These dimmable light units are for example used for the general illumination of the main cabin or for illuminating the wash cabins or for other illumination purposes. In order to make the light units dimmable, pulse width modulation (PWM) is commonly used to drive the light sources. The underlying principle of dimming by pulse width modulation is as follows. The current provided to the light sources is switched on/off at a high frequency which switching cannot be perceived by the human eye. The duty cycle of such pulse width modulation is the portion of the total time that is dedicated to the on-state of the light source. A longer portion of the on-state is perceived by the human eye as a higher light intensity. Consequently, the duty cycle determines the light intensity perceived by the human eye, i.e. the degree of dimming of the light unit.

The switching of the light source drive current results in a non-continuous load for the electricity network, to which the light unit is connected. The switching creates undesired influences on the electricity network. In other words, the switching has an undesired "backwards" effect on the electricity network. An example for such an undesired effect is a current amplitude modulation in the electricity network. This makes an efficient operation of the electricity network difficult. Moreover, the light unit itself has to be provided with circuit elements that can handle such non-continuous current flow.

Accordingly, it would be beneficial to provide a dimmable light unit that poses less of a strain on the electricity network that it is connected to. Further, it would be beneficial to provide a method of replacing existing light units with such improved dimmable light units.

SUMMARY

Exemplary embodiments of the invention include a dimmable LED light unit, in particular for a passenger transport vehicle, such as an aircraft, a road vehicle, a ship or a rail car. The dimmable LED light unit comprises a power input adapted to receive electrical power from a power source, at least one LED, and an LED drive and control module coupled between the power input and the at least one LED, wherein the LED drive and control module is adapted to receive a LED control signal indicative of a desired light intensity of the dimmable LED light unit. The LED drive and control module is configured to provide a drive current to the at least one LED resulting in the desired light intensity of the dimmable LED light unit, the drive current having a drive current amplitude and a drive current duty cycle, wherein the LED drive and control module is configured to set the drive current amplitude within an amplitude range and to set the drive current duty cycle within a duty cycle range in response to the LED control signal.

In this way, the LED drive and control module is adapted to vary two parameters of the drive current for the at least one LED, namely the drive current amplitude and the drive current duty cycle. The LED drive and control module has two means of adjusting the drive current, i.e. two means of adjusting the light intensity perceived by the human eye. Therefore, the LED drive and control module can reach the desired light intensity, while at the same time taking into account other objectives of an efficient control. For example, the LED drive and control module may mainly rely on light intensity control by varying the drive current amplitude in operation ranges where control via varying the drive current duty cycle poses a particular strain on the power source. In other words, providing for two degrees of freedom for controlling the light intensity of the dimmable LED light unit allows for reaching the desired light intensity while reducing the strain on the power source as compared to the case where a pure duty cycle control, i.e. a pure control via pulse width modulation, is used.

Besides, the usage of LEDs allows for the provision of more power efficient light units, such that such LED light units are a smaller load on the electricity network than conventional halogen lights.

The term "power source" refers to any kind of circuit element or circuit module that the dimmable LED light unit is connected to for being supplied with electrical power. In many applications, the power source is an electricity distribution network that is coupled between a power generating device and/or power storage device on the one side and one or more dimmable LED light units and potentially other power consumers on the other side. However, the power source may also be a single power source supplying electrical power to the dimmable LED light unit only.

The term "drive current amplitude" refers to the current value that is provided to the at least one LED when the LED drive current is an on-state in accordance with the applied pulse width modulation. As the duty cycle of the pulse width modulation may be 100%, it is possible that a current with the set drive current amplitude is provided constantly to the at least one LED. Therefore, the drive current amplitude may also be referred to as a drive current intensity or a drive current reference value. It is explicitly pointed out that the term "amplitude" does not require the drive current to have a wave form in all operating scenarios.

The term "duty cycle" is herein used to denote the ratio of the on-state of the drive current, i.e. the duration of the drive current having the drive current amplitude, to the total time for a given time window. In other words, the term duty cycle refers to the portion of the on-state of the drive current and is commonly provided as a percentage number. In this way, the term "duty cycle" is used in its standard meaning in the art with respect to pulse width modulations.

The expressions "amplitude range" and "duty cycle range" do not have any implications per se how wide the range is or how many values the LED drive and control module can choose from. Also, these terms do not require that the LED drive and control module can use all values within a given minimum and maximum value of the ranges. These terms solely specify that the LED drive and control unit is able to set each of the drive current amplitude and the drive current duty cycle to a plurality of values. The duty cycle range may be between 0% and 100%. The amplitude range may be between a minimum and a maximum current amplitude value, with these minimum and maximum current amplitude values being specified in accordance with the LED's used and with the operating circumstances.

According to a further embodiment, the LED drive and control module is configured to set the drive current duty cycle to 100% and to variably set the drive current amplitude within the amplitude range, when the desired light intensity is above a first light intensity threshold value. In other words, for the desired light intensity being high, i.e. for the desired light intensity being above the first light intensity threshold value, the dimming is exclusively done by varying the drive current amplitude without any pulse width modulation of the drive current. In yet other words, the drive current duty cycle being set to 100% means that no switching of the drive current between the on-state and the off-state takes place, such that a constant drive current is supplied to the at least one LED.

In this way, the strain on the electricity network arising from the switching between the on-state and the off-state is eliminated in high load conditions, i.e. in conditions of high current intensities. Consequently, the artefacts introduced back into the electricity network due to the switching of the drive current are eliminated for said high load conditions. Also, other optional input circuits of the dimmable LED light unit, such as a power factor correction circuit discussed below, do not have to be configured to be able to deal with PWM switching at high currents. Moreover, varying the drive current amplitude is a power-efficient way of dimming, because no switching losses are present.

Such a setting of the drive current duty cycle to 100% also improves the dynamic properties of the dimmable LED light unit. Improving the dynamic properties means that the dimming can be performed in finer steps. As compared to prior art light units where the whole dimming operation was performed by varying the duty cycle, the variation of the duty cycle is limited to a more narrow operating range, namely below the first light intensity threshold value. For a given number of steps for controlling the duty cycle, a finer control of the emitted light intensity can be achieved.

The expression to "variably set" the drive current amplitude does not mean that the LED drive and control module varies the drive current amplitude for one given desired light intensity. In contrast, it means that the LED drive and control module sets one fixed drive current amplitude for the given desired light intensity, but sets different drive current amplitudes for different desired light intensity values above the first light intensity threshold value.

According to a further embodiment, the first light intensity threshold value is between 15% and 50% of a maximum light intensity. The term maximum light intensity refers to the brightest setting a user can chose for operating the dimmable LED light unit. Setting the first light intensity threshold value between 15% and 50% has been found to be a good measure to eliminate current switching problems due to PWM for large currents. It has been found that these artefacts create a particular burden on the electricity network and/or on the input circuitry of the dimmable LED light unit for drive current amplitude values above 50% of the maximum current, i.e. the current resulting in the maximum light intensity. These problems can be further reduced by lowering the first light intensity threshold value to 30%, in particular to 25%, or even to 15%. Therefore, according to particular embodiments, the first light intensity threshold value is between 20% and 30% of the maximum light intensity, and more in particular at about 25% of the maximum light intensity.

According to a further embodiment, the LED drive and control module is configured to set the drive current amplitude according to a linear relationship with the desired light intensity, when the desired light intensity is above the first light intensity threshold value. With the drive current duty cycle being at 100%, the whole dimming is effected by the variation of the drive current amplitude. Above a certain threshold, the emitted light intensity of many LED's is in linear relationship with the drive current. Accordingly, setting the drive current amplitude according to a linear relationship with the desired light intensity results in a fairly accurate correspondence between the desired light intensity set by the user and the emitted light intensity perceived by the user. This is achieved while providing above discussed advantages with respect to mere drive current variation dimming in high current conditions.

According to a further embodiment, the LED drive and control module is configured to set the drive current amplitude to a minimum current amplitude value and to variably set the drive current duty cycle within the duty cycle range, when the desired light intensity is below a second light intensity threshold value. In this way, the LED drive and control module ensures that the drive current does not fall below the minimum current amplitude value. This in turn ensures that the at least one LED is not operated with low currents that lead to chromatic aberrations in the emitted light. Also, keeping the drive current amplitude at the minimum current amplitude value ensures that the at least one diode is not operated in a region of a highly non-linear relation between the drive current and the emitted light intensity. In other words, the light intensity and chromatic behavior of the at least one LED is kept constant and well-defined due to the drive current amplitude being at the minimum current amplitude value, while a further dimming to lower light intensity values of the LED light unit is achieved by varying the duty cycle of the pulse width modulation. Accordingly, dimming in a low light intensity range is achieved without chromatic changes in the emitted light and without undesired entering into the off-state of the at least one LED. The minimum current amplitude value is a preset current value that takes into account the number and kind of LED's used.

In a particular embodiment, the minimum current amplitude value corresponds to the second light intensity threshold value. The term corresponds means the following in this context: when the second light intensity threshold value is e.g. at 25% of the maximum light intensity that can be set by the user, the minimum current amplitude value is at 25% of the drive current amplitude that is supplied to the at least one LED when the maximum light intensity is generated.

According to a further embodiment, the second light intensity threshold value is between 15% and 50% of the maximum light intensity, in particular between 20% and 30% of the maximum light intensity, and more in particular at about 25% of the maximum light intensity. It has been found that chromatic aberrations of the at least one LED can be eliminated or kept to an acceptable limit if the drive current amplitude does not fall below these thresholds of the maximum drive current amplitude. It is apparent that this depends on the LED's used and on the operating range used in these LED's. However, it has been found that keeping the drive current amplitude constant at above thresholds of the desired light intensity generally yields the results of eliminating/minimizing chromatic aberrations and of preventing undesired switching off of the at least one LED.

According to a further embodiment, the LED drive and control module is configured to set the drive current duty cycle according to a linear relationship with the desired light intensity, when the desired light intensity is below the second light intensity threshold value. The emitted light intensity, as perceived by the user, is in linear relation with the drive current duty cycle. In other words, the user perceives an average light intensity of the pulse width modulated lighting up of the at least one LED. Therefore, setting the drive current duty cycle according to a linear relationship with the desired light intensity results in a fairly accurate correspondence between the desired light intensity, set by the user, and the emitted light intensity perceived by the user. This is achieved while providing above discussed advantages with respect to mere duty cycle variation dimming in low light intensity conditions.

According to a further embodiment, the first light intensity threshold value is equal to the second light intensity threshold value. In this way, there is a clear separation of dimming by drive current amplitude variation and dimming by drive current duty cycle variation. Above the first light intensity threshold value, the drive current duty cycle is 100%, such that dimming is achieved by varying the drive current amplitude. Below the second light intensity threshold value, which is equal to the first light intensity threshold value, the drive current amplitude is constant at the minimum current amplitude value such that dimming is achieved by varying the drive current duty cycle. This separation of dimming by drive current amplitude variation and dimming by drive current duty cycle variation makes the implementation of the LED drive and control module simple. For any given desired light intensity, the effects of only one varying factor are present and the LED drive and control module is configured to provide an appropriate drive current leading to the desired light intensity with well-defined means. No interdependencies between drive current amplitude variations and drive current duty cycle variations need to be taken into account.

However, it is explicitly pointed out that the first light intensity threshold value and the second light intensity threshold value may also be not equal in further embodiments. In particular, the first light intensity threshold value may be greater than the second light intensity threshold value. In that case, there is a transition region between the first light intensity threshold and the second light intensity threshold where the dimming is achieved by varying both the drive current amplitude and the drive current duty cycle. However, it is still ensured that dimming by drive current amplitude variation only is performed for high load situations, whereas dimming by drive current duty cycle variation only is performed for low load situations.

According to a further embodiment, the LED drive and control module comprises a controller configured to receive the LED control signal and to provide an amplitude control signal indicative of the drive current amplitude and a duty cycle control signal indicative of the drive current duty cycle, and an LED driver configured to receive the amplitude control signal and the duty cycle control signal and configured to provide the drive current to the at least one LED as a response to receiving the amplitude control signal and the duty cycle control signal. In this way, the controlling of the at least one LED and the driving of the at least one LED are separated in two functional units. The controller, which may be a micro processor, is configured to process the LED control signal, which is indicative of the desired light intensity set by the user. Based on the LED control signal, the controller is configured to determine the drive current amplitude and the drive current duty cycle that lead to the dimmable LED light unit emitting light that is perceived by the user to have the desired light intensity. The controller provides two signals to the LED driver, which signals indicate the drive current amplitude and the drive current duty cycle. The LED driver is configured to drive the at least one LED with a drive current having the signalled drive current amplitude and the signalled drive current duty cycle.

According to a further embodiment, the power input is an AC power input adapted to receive electrical power from an AC power source. In this way, the dimmable LED light unit may be configured to be connected to AC power networks. Such AC power networks may be present in many application scenarios, such as for example in air plane cabins.

According to a further embodiment, the dimmable LED light unit comprises a power factor correction circuit coupled between the AC power input and the LED drive and control module, the power factor correction circuit comprising a buffer capacitor. The power factor correction circuit is provided to ensure that the ratio of real power, supplied from the electricity network to the dimmable LED light unit, to the supplied apparent power is high. This ratio is defined as the power factor. A high power factor ensures that the dimmable LED unit draws less current for a given amount of useful power transferred, as compared to a device with a low power factor. In order to achieve a high power factor in the case of a switched load, such as the pulse width modulated drive current to the at least one LED, a buffer capacitor is provided. The higher the switched currents are, the larger the buffer capacitor needs to be.

Accordingly, having the drive current duty cycle at 100% above the first light intensity threshold value, i.e. relying on drive current amplitude dimming only above the first light intensity threshold value, ensures that no switching between the on-state and the off-state takes place for high drive current values. Accordingly, the switching is limited to comparatively low drive current values. This in turn means that the capacitance value of the buffer capacitor can be drastically reduced as compared to dimmable light units that only rely on PWM dimming. With capacitors being costly and voluminous circuit elements, the reduction of the capacitance value makes the whole dimmable LED light unit cheaper and smaller in size.

According to a particular embodiment, the power factor correction circuit is adapted to receive AC power with an AC voltage of between 100 V and 150 V and with an AC current of between 150 mA and 300 mA and wherein the buffer capacitor of the power factor correction circuit is smaller than 75 μF, in particular smaller than 50 μF. These capacitance values of the buffer capacitor are substantially smaller than in prior art devices.

The term capacitor refers to any kind of capacitive element. It may be a stand alone capacitor. However, the capacitance may also be provided by the parasitic capacitance of other circuit elements.

According to a further embodiment, the at least one LED is a chain of a plurality of LED's. A chain of LED's allows for an overall greater brightness than can be achieved with a single LED. Also, the chain of LED's allows for the setting of particularly suitable operating points, with the dimming being achievable without departing very far from those suitable operating points.

Exemplary embodiments of the invention further include a passenger transport vehicle, such as an aircraft, a road vehicle, a ship or a rail car, having at least one dimmable LED light unit, as described in any of the embodiments above, the at least one dimmable LED light unit being positioned in an interior of the passenger transport vehicle. The aircraft may be an air plane or a helicopter. The road vehicle may be a bus, a truck or a car. Above modifications and advantages equally relate to the passenger transport vehicle.

Exemplary embodiments of the inventions further include a method of replacing a used light unit, in particular in a passenger transportation vehicle, such as an aircraft, a road vehicle, a ship or a rail car, with a dimmable LED light unit, as described in any of the embodiments above, the method comprising the steps of disconnecting the used light unit from a power source and connecting the power input of the dimmable LED light unit, as described in any of the embodiments above, to the power source. In this way, new dimmable LED light units, which pose less of a strain to the power source/electricity network, can be included into existing systems in a seamless manner.

BRIEF DESCRIPTION OF THE DRAWINGS

Embodiments of the invention are described in greater detail below with reference to the figures, wherein.

DETAILED DESCRIPTION

Figure 1:
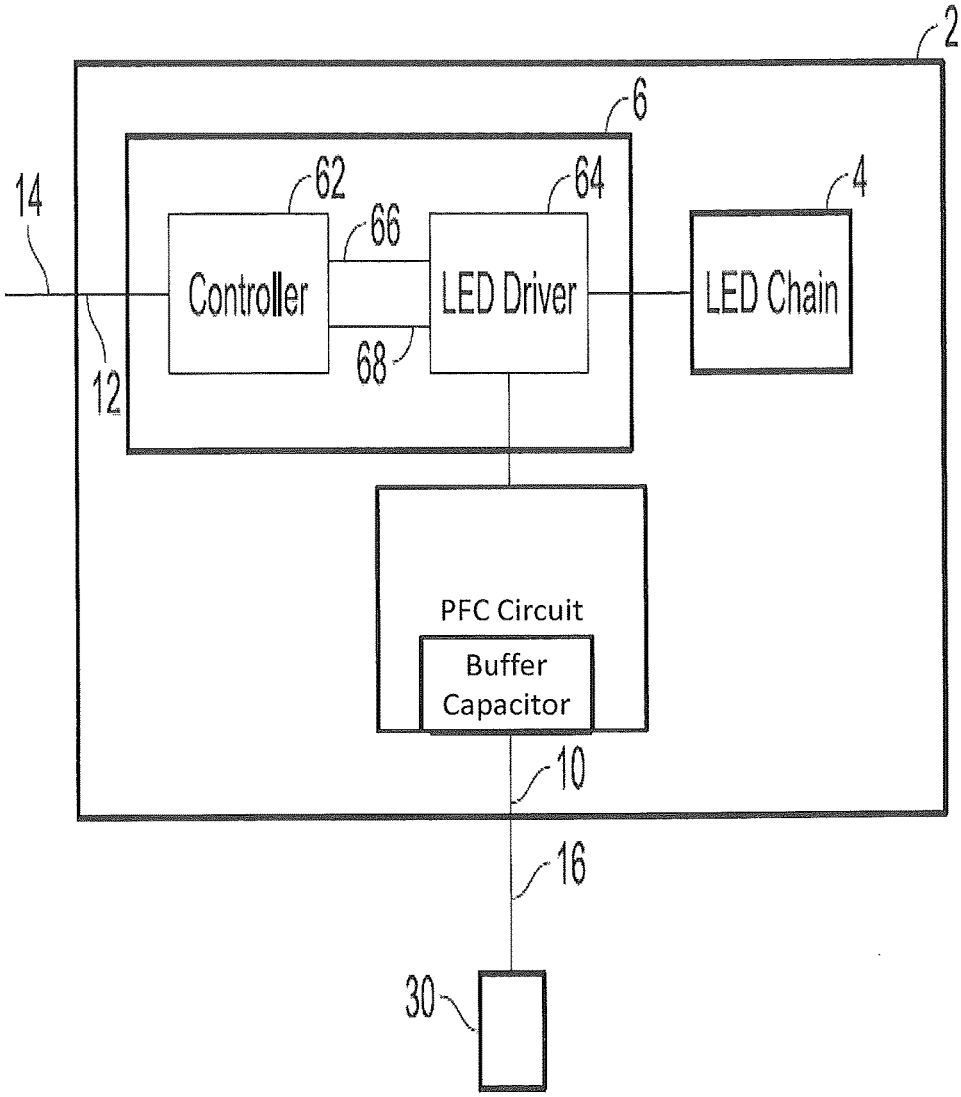
FIG. 1 shows a block diagram of an exemplary embodiment of a dimmable LED light unit and its connections in accordance with the invention.

FIG. 1 shows a block diagram of a dimmable LED light unit and its periphery in accordance with an exemplary embodiment of the invention. The LED light unit 2 is commonly an encased part which can be electrically connected to a power source 30 via a power line 16 and which receives an LED control signal from an LED control signal source (not shown) via an LED control signal line 14. It is also possible that the components of the LED light unit 2 are divided up between different housings. For example, the LEDs 4 may be in a first housing different from a second housing structure where the other elements are arranged. The particular design of the case/cases, including the fixture design and the design of the transparent cover over the LEDs, through which light is emitted, is not relevant to the present invention. According details have been left out in the figures.

The exemplary LED light unit 2 comprises an LED chain 4, an LED drive and control module 6 and a power factor correction circuit 8. The power factor correction circuit 8 is coupled to a power input 10 and to the LED drive and control module 6. The LED chain 4 is coupled to the LED drive and control module 6. The LED drive and control module 6 is further coupled to an LED control signal input 12. The LED drive and control module 6 has a controller 62 and an LED driver 64. The controller 62 is coupled to the LED control signal input 12. The LED driver 64 is coupled to the power factor correction circuit 8 and to the LED chain 4. The controller 62 and the LED driver 64 are coupled by two signal lines, namely a duty cycle control signal line 66 and an amplitude control signal line 68.

The power input 10, which is an AC power input in the present exemplary embodiment, is connected to an AC power source 30 via power line 16. The power source 30 can be any kind of power source, such as stand alone power source, for example a battery, or an electricity network supplying power to multiple consumers.

The LED control signal input is coupled to an LED control signal source (not shown) via LED control signal line 14. The LED control signal source may be any kind of input device, through which a user can set a desired light intensity. This may be a mechanical switch, such as a sliding switch, or a pair of plus and minus switches, through which an incremental control is effected, or a touch screen input device or any other kind of suitable input device.

While the LED control signal line 14, the duty cycle control signal line 66 and the amplitude control signal line 68 are shown as physical signal lines, they can also be dispensed with as long as there is suitable means for communicating the respective signals. For example, the LED control signal may be communicated from the LED control signal source to the LED control signal input 12 in a wireless manner. Similarly, the duty cycle control signal and the amplitude control signal may be communicated from the controller 62 to the LED driver 64 in any suitable way.

The operation of the LED light unit is described as follows. AC power is supplied to the LED light unit 2 from the AC power source 30 via power line 16. This AC power is received by AC power input 10, which is connected to the power factor correction circuit 8. The power factor correction circuit 8 has the function to condition the impedance of the LED light unit 2, as seen by the power source 30. In particular, the power factor correction circuit has reactive circuit elements that balance out other reactive circuit elements present in "downstream" circuit components, such as in the LED drive and control module 6. In particular, the power factor correction circuit 8 has capacitive elements, such as a buffer capacitor.

While conditioning the overall impedance of the LED light unit 2, the power factor correction circuit 8 passes the electric power from the AC power input 10 trough to the LED drive and control module 6, in particular to the LED driver 64. It is pointed out that the power factor correction circuit 8 is an optional circuit structure. It may be provided, depending on the impedance behaviour of the remainder of the LED light unit 2 and depending on the impedance behaviour of the whole LED light unit 2 desired from the power source side.

The AC power is passed to the LED driver 64, where it is first rectified and converted to DC power. Such rectification and AC/DC conversion may also be performed in the power factor correction circuit 8, as will be explained below with reference to FIG. 5*b*. In that case, DC power is supplied to the LED driver 64. Also, a separate AC/DC conversion circuit may be provided between the power factor correction circuit 8 and the LED driver 64 or between the AC power input 10 and the power factor correction circuit 8.

The LED driver 64 generates a drive current for the LED chain 4 from the provided DC power. The drive current for the LED chain 4 has two characteristics, namely a drive current amplitude and a drive current duty cycle. The drive current amplitude refers to the drive current intensity when the drive current is not in a temporary state of zero current due to the duty cycle control requiring an off-state of the drive current. The drive current duty cycle refers to the portion of a time interval where the drive current is an on-state, i.e. where the drive current has the drive current amplitude. This definition is in accordance with standard duty cycle definitions for pulse width modulated signals. Accordingly, the LED driver 64 generates a drive current that has a particular drive current amplitude and a particular drive current duty cycle and provides said drive current to the LED chain 4.

The drive current duty cycle corresponds to a duty cycle value signalled from the controller 62 via the duty cycle control line 66. Equally, the drive current amplitude corresponds to an amplitude value signalled from the controller 62 via amplitude control signal line 68. In this way, the LED driver 64 executes the LED control, as indicated by the duty cycle control signal and the amplitude control signal, and provides an according drive current to the LED chain 4.

The generation of the duty cycle control signal and the amplitude control signal by the controller 62 is described with reference to FIGS. 2 and 3. The controller 62 receives an LED control signal from the LED control signal input 12. The LED control signal is indicative of a desired light intensity, i.e. a light intensity communicated by the user to the LED light unit 2 via a suitable interface. The desired light intensity is given as a percentage number of the maximum light intensity, i.e. of the highest light intensity that the user can select in his interface.

Figure 2:
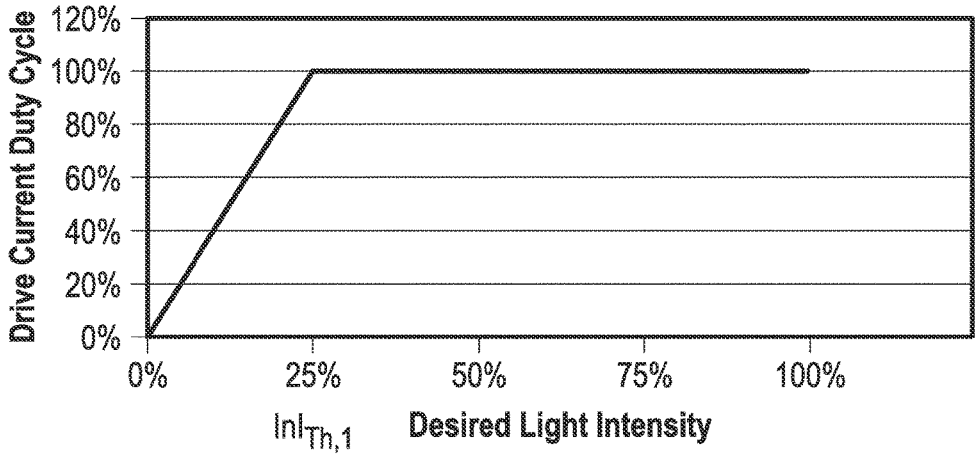
FIG. 2 shows a function diagram representing the drive current duty cycle in relation to the desired light intensity.
Figure 3:
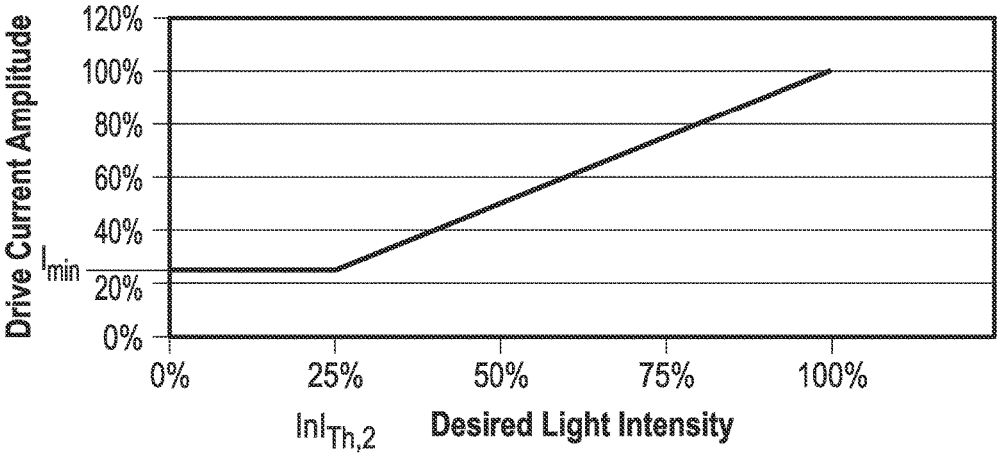
FIG. 3 shows a function diagram representing the drive current amplitude in relation to the desired light intensity.

This desired light intensity is given on the x-axis of FIG. 2 and FIG. 3, respectively. FIG. 2 shows to which value the controller 62 sets the drive current duty cycle for all desired light intensities from 0% to 100%. Similarly, FIG. 3 shows to which value the controller 62 sets the drive current amplitude for all desired light intensities between 0% and 100%. The duty cycle control signal and the amplitude control signal may communicate the information about the drive current duty cycle and the drive current amplitude in any suitable way. For example, a particular voltage on the duty cycle control signal line 66 and on the amplitude control signal line 68 may signal the respective drive current duty cycle and drive current amplitude, respectively. Any other way of signalling, such as pulse width modulation, may also be employed on the duty cycle control signal line 66 and the amplitude control signal line 68.

As can be seen from FIG. 2, the drive current duty cycle is set to 100% for all desired light intensity values above 25%. Below 25%, the drive current duty cycle has a linear relationship with the desired light intensity. In other words, the drive current duty cycle, signalled by the controller 62 to the LED driver 64 via duty cycle control signal line 66, is set by the controller 62 in accordance with a linear function between desired light intensity and drive current duty cycle. In particular, the drive current duty cycle increases from 0% to 100% for the desired light intensity range from 0% to 25%. In accordance with the terminology of this invention, the first light intensity threshold value IntTh,1 is at 25% of the maximum light intensity in this exemplary embodiment.

As is apparent from FIG. 3, the drive current amplitude, signalled by the controller 62 to the LED driver 64 via amplitude control signal line 68, is 25% of the maximum drive current amplitude for desired light intensities between 0% and 25%. Again, the term maximum drive current amplitude refers to the drive current amplitude that makes the LED light unit shine as bright as the user can set it. For desired light intensities between 25% and 100%, the drive current amplitude has a linear relationship with the desired light intensity. In particular, the drive current amplitude increases from 25% to 100% of the maximum drive current amplitude, while the desired light intensity also increases from 25% to 100%. Accordingly, for desired light intensities above 25%, the controller 62 sets the desired drive current amplitude value to a percentage value equal to the desired light intensity. In accordance with the terminology of this invention, the second light intensity threshold value IntTh,2 is at 25% of the maximum light intensity in this exemplary embodiment. Further in accordance with the terminology of this invention, the minimum current amplitude value IMin is also at 25% of the maximum drive current amplitude.

In more general terms, the controller 62 has two functions stored in its memory. Examples of these two functions are shown in FIGS. 2 and 3. For any given desired light intensity, as received from the LED control signal input 12, the controller 62 selects a drive current duty cycle and a drive current amplitude in accordance with these two functions. The controller 62 then puts signals on the duty cycle control signal line 66 and the amplitude control signal line 68, those two signals being indicative of the drive current duty cycle and the drive current amplitude. As explained above, the LED driver 64 processes those two signals and generates an according drive current for the LED chain 4.

The two functions of the drive current amplitude and of the drive current duty cycle in dependence of the desired light intensity may be stored in the controller 62 as look-up tables or in analytical form.

Above discussed advantages of the exemplary embodiment of the invention can be nicely illustrated in connection with FIGS. 2 and 3. The dimming operation is carried out differently for the desired light intensity range below 25% and for the desired light intensity range above 25%. In other words, there is one threshold value for two different dimming regimes of the LED light unit 2. As there is only one threshold value, this threshold value of 25% is both the first light intensity threshold value IntTh,1 as well as the second light intensity threshold value IntTh,2 in the terminology of this application. In other words, the first light intensity threshold value IntTh,1 is equal to the second light intensity threshold value IntTh,2 in this exemplary embodiment. It is explicitly pointed out that this is not a requirement, but that the first light intensity threshold value may be different from the second light intensity threshold value.

Below a desired light intensity of 25%, the drive current amplitude is kept constant at 25% of the maximum drive current amplitude. Consequently, the LED chain is not in any danger of accidentally entering an off-state, and no chromatic aberrations or very little chromatic acceptable aberrations are present. At the same time, effective dimming can be achieved in this low light intensity range by varying the duty cycle of the drive current from 0% to 100%. As the application of the pulse width modulation is restricted to this low light intensity range, a four times finer adjustment of the light intensity may be achieved with a given number of steps for adjusting the duty cycle (as compared to the prior art where the whole dimming operation is performed via varying the duty cycle).

Above a desired light intensity of 25%, the duty cycle is set to 100%, such that a continuous drive current is supplied to the LED chain and no PWM switching takes place in this high light intensity range, which is also a high current amplitude range. Therefore, the problems arising within the LED light unit 2 and introduced into the power source 30 from the LED light unit 2 due to the PWM switching are not present for this range of high drive currents. The dimming operation is only achieved with varying the drive current amplitude, which drive current amplitude is the intensity of a continuous current supplied to the LED chain 4.

Figure 4:
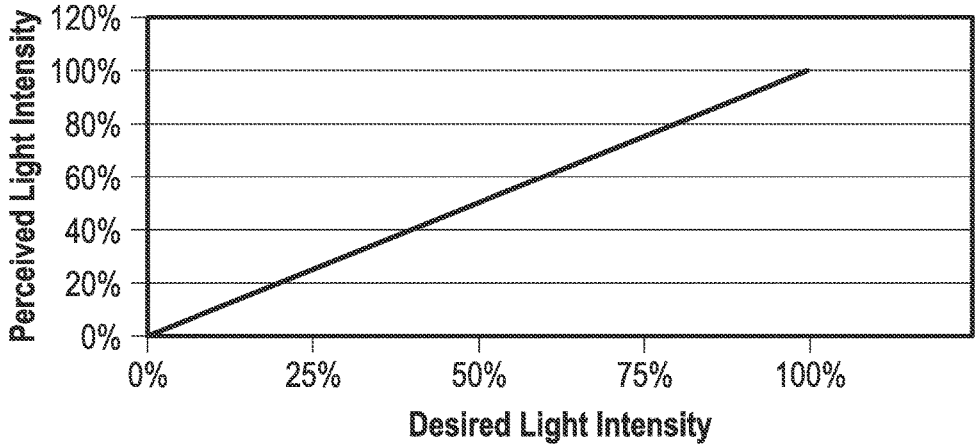
FIG. 4 shows a diagram representing the resulting perceived light intensity in relation to the desired light intensity.

FIG. 4 shows a diagram representing the resulting perceived light intensity in relation to the desired light intensity, which is again shown on the x-axis. As is apparent, the user perceives a continuous and seamless dimming action between 0% and 100% of the maximum light intensity. The variation of the duty cycle and the variation of the amplitude of the drive current complement each other and lead to a dimming behaviour between the desired light intensity and the perceived light intensity that is very convenient for the user.

It is pointed out that the LED control signal, which has been said to be set by the user, may be set by a human user or any other entity capable of sending an LED control signal, such as for example a board computer in an aircraft.

Figure 5A:
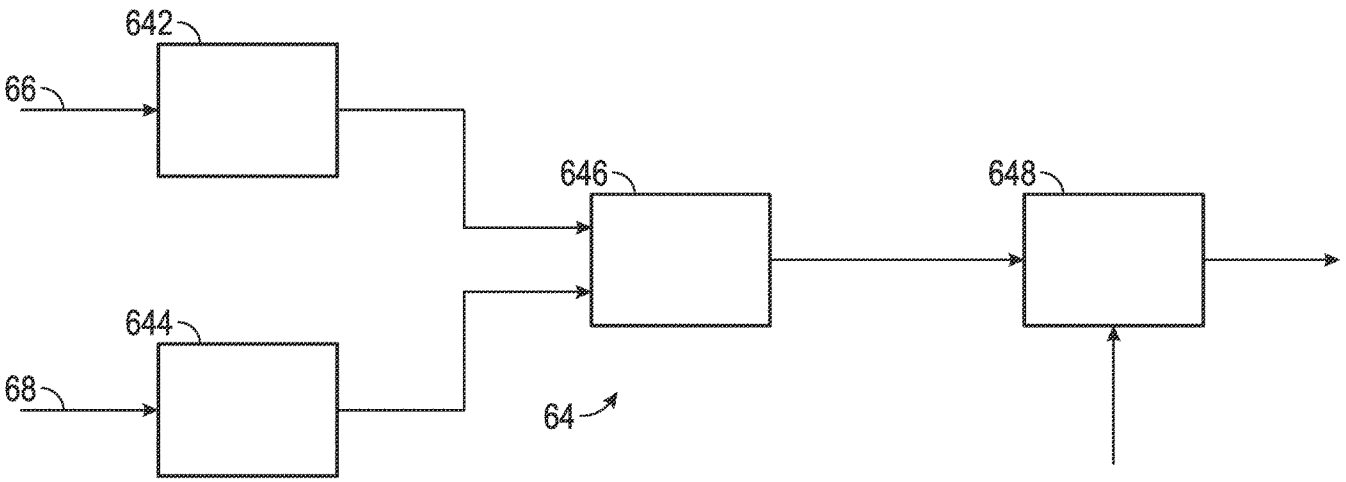
FIGS. 5*a* and 5*b* show block diagrams of exemplary implementations of the LED driver and the power factor control circuit modules.

FIG. 5*a* shows a block diagram of an exemplary implementation of the LED driver 64, shown as one block in FIG. 1. It is pointed out that this implementation is an example only and that other implementations are equally possible. The exemplary LED driver 64 has a duty cycle input circuit 642, an amplitude input circuit 644, a driver logic 646, and an LED driver power unit 648.

The duty cycle input circuit 642 is coupled between the duty cycle control signal line 66 and the driver logic 646. It receives the duty cycle control signal from the controller 62 via the duty cycle control signal line 66 and conditions it in such a way that it can be processed by the driver logic 646. The amplitude input circuit 644 is coupled between the amplitude control signal line 68 and the driver logic 646. It receives the amplitude control signal from the controller 62 via the amplitude control signal line 68 and conditions it in such a way that it can be processed by the driver logic 646.

The driver logic 646 is coupled between the duty cycle input circuit 642, the amplitude input circuit 644 and the LED driver power unit 648. It receives above described signals from the duty cycle input circuit 642 and the amplitude input circuit 644 and generates a single driver control signal for controlling the LED driver power unit. The LED driver power unit receives said driver control signal from the driver logic 646 and receives DC power the power factor correction circuit 8. It drives the LED chain 4 as a response to said driver control signal, which results in the desired operation of the LED chain 4, as discussed above.

Figure 5B:
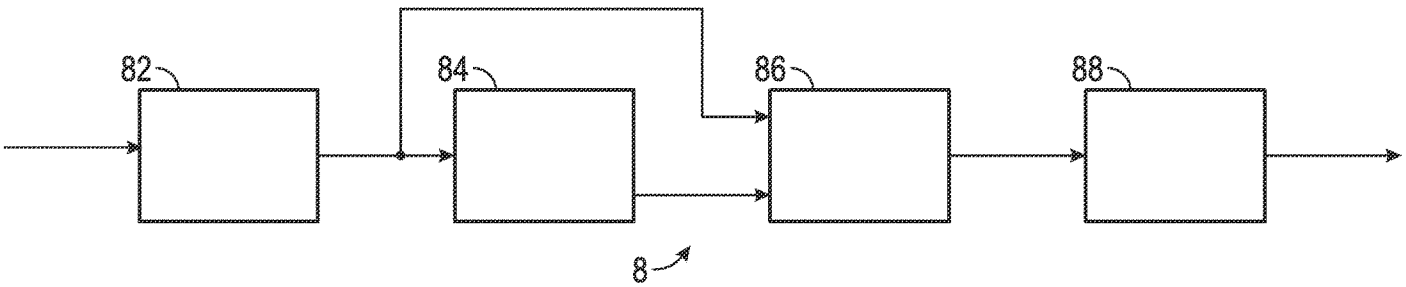

FIG. 5*b* shows a block diagram of an exemplary implementation of the power factor correction circuit 8, shown as one block in FIG. 1. It is pointed out that this implementation is an example only and that other implementations are equally possible. The exemplary power factor correction circuit 8 has a rectifier 82, a power factor correction controller 84, a boost circuit 86, and a buffer capacitor 88.

The rectifier 82 receives the AC power from the AC power input 10. It provides the rectified AC voltage to the boost circuit 86. The power factor correction controller 84 senses the rectified AC voltage and provides a boost circuit control signal to the boost circuit 86 as a response thereto. The boost circuit 86 conditions the rectified AC voltage from the rectifier 82 in response to the boost circuit control signal. For example, the boost circuit 86 may perform a DC/DC conversion in such a way that the LED light unit 2 as a whole has a high power factor. In this way, the power factor correction controller 84 and the boost circuit 86 may work together in achieving a favourable power factor correction. The boost circuit outputs an unbuffered output voltage to the buffer capacitor 88. At the output of the buffer capacitor 88, a buffered output voltage is present, which may be used by the LED driver 64 for driving the LED chain 4.

The dimmable LED light unit may be operated in the following manner. The power source 30, which may be an electricity distribution network, may provide a voltage of 115 V and operate at a frequency of 400 Hz. The LED light unit may operate with a power consumption of 20-25 W and may operate with an AC current of 200-250 mA. In this way, the LED light unit may require around 50% less power than conventional halogen lights. A capacitor of less than 50% of the capacitance value of prior art capacitors can be used in the power factor correction circuit, because PWM induced switching only takes place at low drive currents. In the present example, the buffer capacitor in the power factor correction circuit may be 47 μF.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed, but that the invention will include all embodiments falling within the scope of the appended claims.

The invention claimed is:

1. An aircraft interior lighting system, comprising:

an on-board AC electricity distribution network; and at least one dimmable interior aircraft LED light unit comprising:

a power input adapted to receive electrical power from a power source, at least one LED, and an LED drive and control module coupled between the power input and the at least one LED, wherein the LED drive and control module is adapted to receive an LED control signal indicative of a desired light intensity of the dimmable LED light unit, wherein the LED drive and control module is configured to provide a drive current to the at least one LED resulting in the desired light intensity of the dimmable LED light unit, the drive current having a drive current amplitude and a drive current duty cycle, wherein the LED drive and control module is configured to set the drive current amplitude within an amplitude range and to set the drive current duty cycle within a duty cycle range in response to the LED control signal;

wherein the LED drive and control module is configured to set the drive current duty cycle to 100% and to variably set the drive current amplitude within the amplitude range, when the desired light intensity is above a first light intensity threshold value ($In_{Th,1}$), and wherein the power input is an AC power input connected to the on-board AC electricity distribution network and adapted to receive electrical power from the on-board AC electricity distribution network, and wherein the on-board electricity distribution network provides a voltage of 115 V and operates at a frequency of 400 Hz;

wherein the dimmable interior aircraft LED light unit further comprises a power factor correction circuit coupled between the AC power input and the LED drive and control module, the power factor correction circuit comprising a buffer capacitor, wherein the buffer capacitor of the power factor correction circuit is smaller than 75 μF;

wherein the at least one dimmable interior aircraft LED light unit comprises at least one of an aircraft cabin general illumination light unit and a wash cabin illumination light unit.

2. An aircraft interior lighting system according to claim 1, wherein the first light intensity threshold value ($In_{Th,1}$) is between 15% and 50% of a maximum light intensity.

3. An aircraft interior lighting system according to claim 1, wherein the LED drive and control module of the dimmable interior aircraft LED light unit is configured to set the drive current amplitude according to a linear relationship with the desired light intensity, when the desired light intensity is above the first light intensity threshold value ($In_{Th,1}$).

4. An aircraft interior lighting system according to claim 1, wherein the LED drive and control module of the dimmable interior aircraft LED light unit is configured to set the drive current amplitude to a minimum current amplitude value ($I_{Min}$) and to variably set the drive current duty cycle within the duty cycle range, when the desired light intensity is below a second light intensity threshold value ($In_{Th,2}$).

5. An aircraft interior lighting system according to claim 4, wherein the second light intensity threshold value ($In_{Th,2}$) is between 15% and 50% of the maximum light intensity.

6. An aircraft interior lighting system according to claim 4, wherein the LED drive and control module of the dimmable interior aircraft LED light unit is configured to set the drive current duty cycle according to a linear relationship with the desired light intensity, when the desired light intensity is below the second light intensity threshold value ($In_{Th,2}$).

7. An aircraft interior lighting system according to claim 4, wherein the first light intensity threshold value ($In_{Th,1}$) is equal to the second light intensity threshold value ($In_{Th,2}$).

8. An aircraft interior lighting system according to claim 4, wherein the second light intensity threshold value ($In_{Th,2}$) is between 20% and 30% of the maximum light intensity.

9. An aircraft interior lighting system according to claim 4, wherein the second light intensity threshold value ($In_{Th,2}$) is at about 25% of the maximum light intensity.

10. An aircraft interior lighting system according to claim 1, wherein the LED drive and control module of the dimmable interior aircraft LED light unit comprises:

a controller configured to receive the LED control signal and to provide an amplitude control signal indicative of the drive current amplitude and a duty cycle control signal indicative of the drive current duty cycle, and an LED driver configured to receive the amplitude control signal and the duty cycle control signal and configured to provide the drive current to the at least one LED (4) as a response to receiving the amplitude control signal and the duty cycle control signal.

11. An aircraft interior lighting system according to claim 1, wherein the power factor correction circuit of the dimmable interior aircraft LED light unit is adapted to receive AC power with an AC voltage of between 100 V and 150 V and with an AC current of between 150 mA and 300 mA.

12. An aircraft interior lighting system according to claim 1, wherein the at least one LED of the dimmable interior aircraft LED light unit is a chain of a plurality of LED's.

13. An aircraft having the aircraft interior lighting system of claim 1, with the at least one dimmable interior aircraft LED light unit being positioned in an interior of the aircraft.

14. An aircraft interior lighting system according to claim 1, wherein the first light intensity threshold value ($In_{Th,1}$) is between 20% and 30% of the maximum light intensity.

15. An aircraft interior lighting system according to claim 1, wherein the first light intensity threshold value ($In_{Th,1}$) is at about 25% of the maximum light intensity.

16. An aircraft interior lighting system according to claim 1, wherein the power factor correction circuit is adapted to receive AC power with an AC voltage of between 100 V and 150 V and with an AC current of between 150 mA and 300 mA and wherein the buffer capacitor of the power factor correction circuit is smaller than 50 μF.

17. Method of replacing a used light unit in an aircraft interior lighting system with a dimmable LED interior aircraft light unit according to claim 1, the method comprising the steps of:

disconnecting the used light unit from the on-board electricity distribution network; and connecting the power input of the dimmable LED interior aircraft light unit according to claim 1 to the on-board electricity distribution network.

* * * * *